US007123688B2

(12) United States Patent
Negle

(10) Patent No.: US 7,123,688 B2
(45) Date of Patent: Oct. 17, 2006

(54) X-RAY TUBE

(75) Inventor: Hans Negle, Nahe (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/515,732

(22) PCT Filed: May 23, 2003

(86) PCT No.: PCT/IB03/01976

§ 371 (c)(1),
(2), (4) Date: Nov. 24, 2004

(87) PCT Pub. No.: WO03/103346

PCT Pub. Date: Dec. 11, 2003

(65) Prior Publication Data

US 2005/0163281 A1 Jul. 28, 2005

(30) Foreign Application Priority Data

May 31, 2002 (DE) ..... 102 24 292

(51) Int. Cl.
*H05G 1/52* (2006.01)

(52) U.S. Cl. ..... 378/113; 378/137; 378/138

(58) Field of Classification Search ..... 378/137, 378/138, 113

See application file for complete search history.

(56) References Cited

U.S. PATENT DOCUMENTS

| | | | | |
|---|---|---|---|---|
| 3,852,605 | A * | 12/1974 | Watanabe et al. | 378/113 |
| 4,926,452 | A * | 5/1990 | Baker et al. | 378/22 |
| 5,199,054 | A * | 3/1993 | Adams et al. | 378/21 |
| 2003/0141450 | A1 * | 7/2003 | Craven et al. | 250/310 |

FOREIGN PATENT DOCUMENTS

| | | | |
|---|---|---|---|
| EP | 0279317 | | 8/1988 |
| JP | 52104889 | A * | 9/1977 |
| JP | 54023492 | A * | 2/1979 |

* cited by examiner

*Primary Examiner*—Edward J. Glick
*Assistant Examiner*—Jurie Yun

(57) ABSTRACT

The invention relates to an X-ray tube which includes a device for at least substantially protecting an object to be examined against the incidence of undesirable X-rays (E) which can be produced notably by the decay of a residual or surplus charge present in a high-voltage circuit after an X-ray exposure. To this end there is provided at least one device (341, 342) for deflecting and/or defocusing the electron beam (E) produced by the residual and/or surplus charge in such a manner that at least it is not incident to a significant extent on a region (22) of an anode (2) wherefrom X-rays excited thereby are directed towards an object to be examined.

13 Claims, 5 Drawing Sheets

X-RAY TUBE

The invention relates to an X-ray tube which includes a device for protecting an object to be examined at least substantially against the incidence of undesirable X-rays which can be produced notably by the decay of residual or surplus charges still present in a high-voltage circuit of the X-ray tube after the termination of an exposure.

EP 0 279 317 discloses an X-ray diagnostic device in which a thyristor circuit is connected parallel to an X-ray tube. After the termination of an X-ray exposure by interruption of the anode voltage (high voltage), the thyristor circuit is turned on by means of a drive circuit so that (residual) charges present in smoothing capacitances and cable capacitances at the high-voltage side are eliminated mainly via the thyristor circuit and to a minor extent only via the X-ray tube. The X-ray voltage and the X-ray current, and hence also the undesirable X-rays which are caused thereby and may still constitute a substantial part of the imaging dose notably in the case of high tube voltages, short exposure times and small X-ray currents, even after the switching off of the high voltage, can thus be reduced faster and avoided, respectively, thus improving the edge steepness when the X-ray tube is switched off.

It is a major drawback of this device, however, that almost the entire residual charge to be eliminated has to be converted into loss heat in the thyristor circuit. This has an effect notably in the case of fast pulsation so that the thyristor circuit should comprise components which can be loaded accordingly. Moreover, because of the comparatively large (notably parasitic) capacitances in the high-voltage circuit, the edge steepness with which the tube voltage and the tube current can be reduced is not so great that an undesirable radiation dose can be avoided completely.

A similar problem is encountered in grid-controlled X-ray tubes in which an exposure is not terminated by switching off the high voltage, but by blocking a grid. Granted, a tube current can no longer flow in these tubes after the end of the exposure, so that no X-rays can be generated either. However, when a next exposure is to be carried out with a lower high voltage, first the voltage difference which is due to (surplus) charges still present in the capacitances of the high voltage circuit must be reduced in order to prevent the object to be examined from being exposed to an undesirable radiation dose.

Finally, an undesirable radiation dose may also occur in X-ray tubes comprising two filaments, for example, when it is desired to switch over as quickly as possible from a fluoroscopy mode (with a small focus) to an exposure mode (with a large focus). Generally speaking, in X-ray tubes of this kind only the filament intended for the small focus can be blocked by means of a grid, so that upon switching over to the other filament an electron beam can be generated, and hence X-rays excited, immediately when the filament current is increased, that is, already during the preparation phase for the exposure, as a result of (residual) charges (or possibly when the high voltage is switched on) still present in the capacitances of the high-voltage circuit.

If, moreover, a preceding exposure was carried out with a higher high voltage, it will first be necessary to reduce the voltage difference caused by the (surplus) charges still stored in the capacitances of the high-voltage circuit before the lower high voltage is actually present, so that initially the object to be examined is again exposed to an undesirable radiation dose in this case.

The undesirable radiation dose as mentioned in the above cases is generally generated by soft X-rays which burden or can even damage in particular the skin of a patient.

Therefore, it is an object of the invention to provide an X-ray tube such that an object to be examined can be protected at least substantially against undesirable X-rays which could be produced in particular by the decay of residual or surplus charges present in a high-voltage circuit after an X-ray exposure.

It is notably an object of the invention to provide an X-ray tube such that an object to be examined is not burdened by undesirable X-rays caused by the decay of surplus charges stored in a high-voltage circuit during the execution of an exposure with a high voltage (anode voltage, kV voltage) which is lower than that used during a preceding exposure.

It is also an object to provide an X-ray tube such that, even in the case of fast switching over from the fluoroscopy mode to the exposure mode, notably by switching over between two filaments, no undesirable X-rays are generated during the preparation phase in which a filament which is not to be blocked by means of a grid is heated due to residual charges and/or surplus charges which are still present in the capacitances of the high-voltage circuit and originate from a preceding exposure.

Finally, in the case of an X-ray tube without a grid it is also an object to eliminate at least substantially undesirable X-rays which are produced by residual charges in a high-voltage circuit after the switching off of the high voltage and lead to inadequate edge steepness of the X-rays after the switching off.

In conformity with claim 1 the object is achieved by means of an X-ray tube which includes a first device which can be activated between two successive exposures in order to generate a deflection pulse for deflecting and/or defocusing an electron beam, generated by a residual or surplus charge present in a high-voltage circuit of the X-ray tube, in such a manner that at least it is not incident to a significant extent on a region of an anode wherefrom X-rays excited thereby are directed towards an object to be examined.

In this context a "significant extent" is to be understood to mean an extent such that X-rays are generated which expose an object to be examined to an undesirable radiation dose, that is, a radiation dose which cannot be used in a defined manner for imaging or which notably burdens the skin of a patient.

A special advantage of this solution resides in the fact that it is not necessary to switch currents at the high-voltage side and that the charge is not converted into a loss power in electrical components, so that no power circuits are required in this respect. What is more, a switching unit in accordance with the invention is rather small and economical and can be realized so as to be integrated in the vicinity of the tube, for example, in the tube head.

Furthermore, the solution in accordance with the invention not only enables a reduction but also complete elimination to be achieved for undesirable X-rays as described above.

In addition to these advantages, the solution in accordance with the invention also enables faster pulsed operation with an even greater edge steepness for X-ray tubes which are switched on and off by the switching of the high voltage.

The dependent claims relate to further advantageous embodiments of the invention.

The embodiment disclosed in claim 2 is intended notably for grid-controlled X-ray tubes for which claim 6 discloses a preferred embodiment.

The claims 3 to 5 relate to preferred embodiments of the first device whereby particularly simple and effective deflection and/or defocusing of the electron beam can be carried out.

The embodiment in conformity with claim 7 offers the advantage that the deflected electron beam cannot reach the surroundings in an uncontrolled manner.

The claims 8 and 9 relate to a preferred high-voltage generator for an X-ray tube, which generator is also suitable for operating the devices in conformity with the claims 1 to 6.

Further details, features and advantages of the invention will become apparent from the following description of preferred embodiments which is given with reference to the accompanying drawing. Therein:

Identical or corresponding parts or components in these Figures are denoted by the same reference numerals.

The embodiments shown concern notably grid-switched or grid-controlled X-ray tubes in which an exposure is terminated by the switching or blocking of a grid (GCF: grid-controlled fluoroscopy; GAF: grid-assisted fluoroscopy etc.).

The principle in conformity with the invention can also be advantageously used for the previously mentioned X-ray tubes with two filaments (for example, for a small focus and a large focus) where direct switching over takes place from a grid-switched fluoroscopy mode to an exposure mode in that the filament (large focus) which is not to be blocked by means of a grid and serves for an exposure mode is heated to a high temperature.

Finally, the principle in accordance with the invention can also be used for the previously mentioned X-ray tubes without a grid where an exposure is terminated by switching off the high voltage and where the residual charge still present in the capacitances of the high-voltage circuit becomes manifest as an insufficient edge steepness with which the X-rays decay.

The embodiments to be described hereinafter thus serve for the at least substantial protection of an object to be examined against the incidence of undesirable X-rays which can be caused notably by the decay of residual or surplus charges still present after an X-ray exposure.

Such a residual or surplus charge is notably the charge which, after the termination of an X-ray exposure, prevails in high-voltage leads, secondary windings of high-voltage transformers or other, notably parasitic capacitances of the high-voltage circuit.

In order to protect an object to be examined, an electron beam generated by this charge is deflected and/or defocused by means of a deflection pulse in such a manner that it is not incident, or at least not to a significant extent, on the part of the anode on which the X-rays intended for imaging are excited in normal operation of the X-ray tube. Such deflection can be realized by means of an electrical and/or magnetic field; alternatively or additionally defocusing of the electron beam can also be carried out by appropriate control of electron lenses or other devices, such as deflection coils, which serve to concentrate the electron beam in normal operation of the X-ray tube. In the case of a grid-controlled X-ray tube, or a filament which is blocked by a grid, the electron beam is to be eliminated by switching through the tube by means of a discharge pulse.

Figure 1:
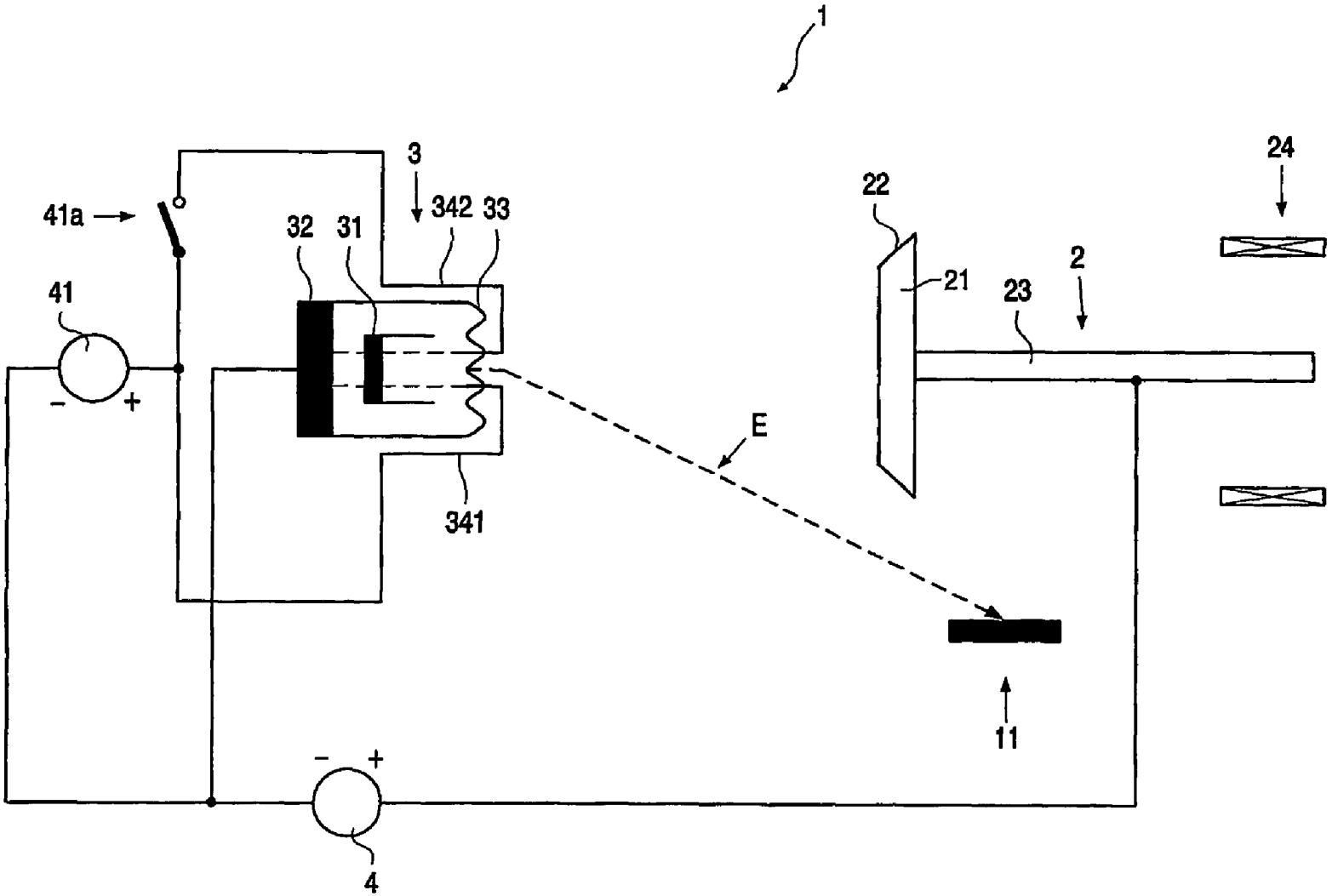
FIG. 1 shows a circuit diagram of a first embodiment of the invention.

FIG. 1 is a diagrammatic representation of a first embodiment of the invention.

An X-ray tube in accordance with the invention thus includes essentially a tube envelope 1 of glass or metal which encloses a vacuum space in which an anode 2 and a cathode 3 are accommodated. Between the anode 2 and the cathode 3 there is situated an anode voltage source 4 whereby the anode voltage (high voltage) is generated.

The anode 2 consists in a customary manner of an anode disc 21 with a beveled edge zone 22 as well as an anode rod 23. Also provided is a stator 24 via which the anode 2 is rotated.

The cathode 3 includes a filament transformer with a primary winding 31 and a secondary winding 32 for at least one filament 33, as well as a cathode tube (Wehnelt cylinder) which is divided into two parts in the present embodiment so that it consists of a first tube half 341 and a second tube half 342 which are electrically insulated from one another. There is also provided a bias voltage source 41 which is connected to the first tube half 341 and can also be connected at option to the second tube half 342 by closing a switch 41*a*, so that the first and second tube halves 341 and 342 are positively biased relative to the filament 33.

Finally, a radiation collector 11 is provided on the wall of the tube envelope or on a protective tube housing (head), which collector is made of, for example, lead or another material which at least substantially absorbs an incident electron beam and may be formed by a suitably reinforced wall zone of the protective tube housing or the tube envelope 1.

In the exposure mode the X-ray tube generates an X-ray beam in a customary manner by accelerating, while the switch 41*a* is closed, the electrons released from the filament 33 and focused by the cathode tube 341, 342 by means of the anode voltage, said electrons being incident in the form of an electron beam on the edge zone 22 of the anode disc 21; therefrom the X-rays thus excited are directed towards the object to be examined via a window in the tube envelope 1.

After the termination of an exposure by the switching over of the bias voltage source 41 in such a manner that the cathode tube 341, 342 is negatively biased relative to the filament 33 so that the electron beam is interrupted, an occasionally very substantial residual charge remains in the anode voltage circuit also after the switching off, if applicable, of the high voltage; such a residual charge must be eliminated prior to the beginning of an exposure, in particular if this exposure is to be performed with a lower high voltage. When the high voltage is not switched off but switched over directly to the lower value, the relevant surplus charge must be eliminated.

To this end, the switch 41*a* is opened and a suitable positive voltage is generated by way of the bias voltage source 41, so that the first tube half 341 is positively biased relative to the filament 33 and also relative to the second tube half 342. Thus, on the one hand the tube is switched through so that an electron beam E is generated because of the residual or surplus charge, and on the other hand the electron beam E is deflected in the direction of the radiation collector 11 because of the unequal potentials on the two tube halves 341, 342. Said positive voltage on the bias voltage source 41 thus represents a deflection pulse and a discharge pulse at the same time.

The residual or surplus charge is thus eliminated, without exciting X-rays on the anode 2.

In this respect it is to be noted that the deflection and discharge pulse is generated only when the switch 41*a* is open. The period of time during which the switch is open and the duration of the discharge and deflection pulse are proportioned in such a manner that the residual or surplus charge is eliminated essentially completely. Subsequently, an imaging exposure can be carried out with a defined high voltage and hence with a desired X-ray dose.

Figure 2:
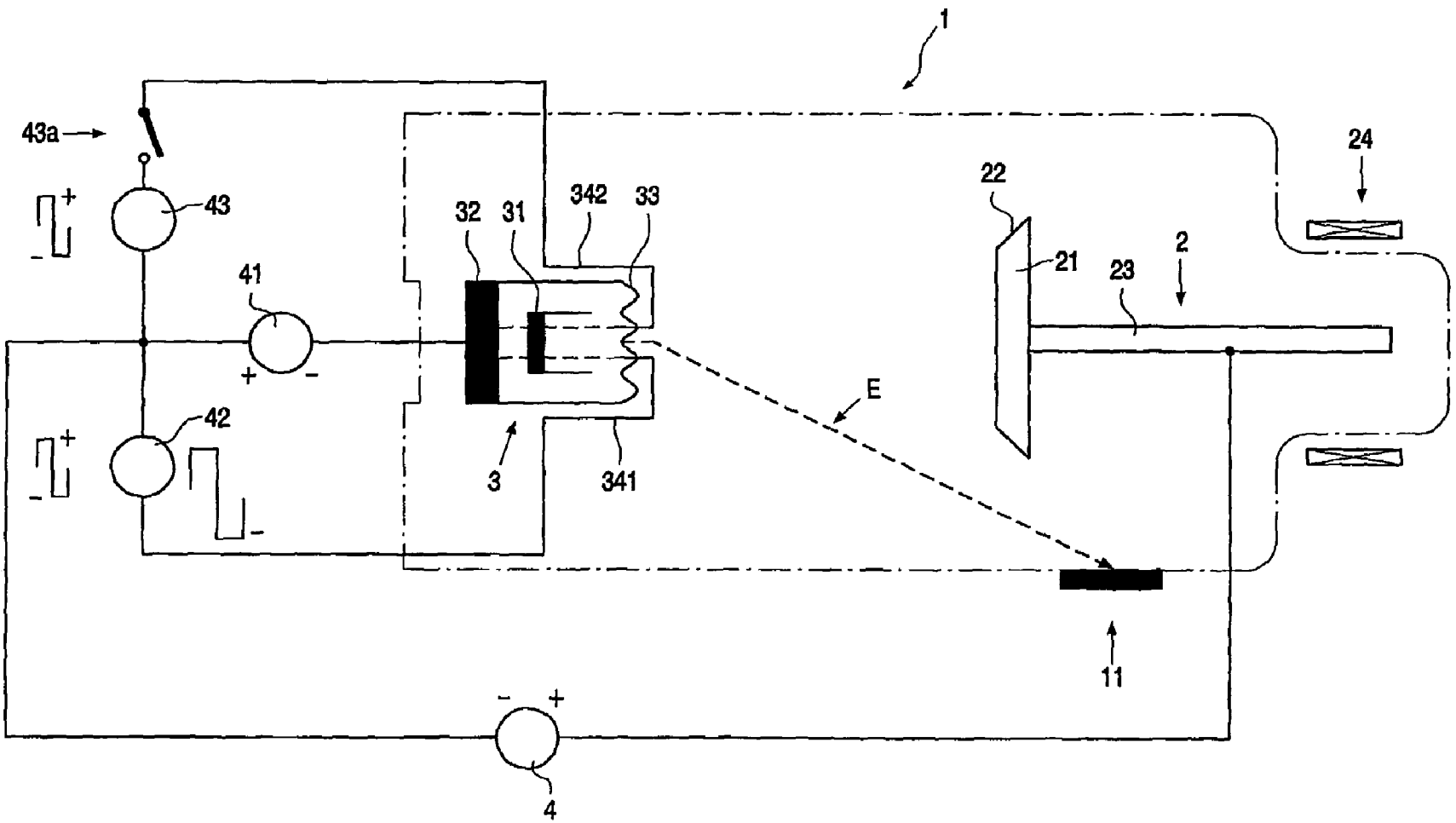
FIG. 2 shows a circuit diagram of a second embodiment of the invention.

FIG. 2 shows a second embodiment of the invention, parts which are similar to or correspond to parts shown in FIG. 1 being denoted by the same reference numerals.

In this embodiment the glass envelope 1 again accommodates an anode 2 with an anode disc 21 with a beveled edge zone 22 and an anode rod 23 which is driven via a stator 24. Also provided is a cathode 3 with a two-piece cathode tube which comprises a first tube half 341 and a second tube half 342 as well as a filament transformer with a primary winding 31 and a secondary winding 32. The at least one filament 33, being connected to the secondary winding 32, can be biased positively or negatively relative to the cathode tube 341, 342 by means of a first bias voltage source 41.

There is also provided a second bias voltage source 42 whereby the first tube half 341 can be biased positively or negatively relative to the filament 33. Using a third bias voltage source 43, the second tube half 342 can also be biased relative to the filament 33 by means of a positive or negative voltage by closing a switch 43*a*.

Finally, the anode voltage source 4 is connected to the anode 2 and, via the first bias voltage source 41, to the filament 33.

In order to eliminate the residual or surplus charges after an X-ray exposure, a bias voltage source 41 generates a discharge pulse whereby the filament 33 is negatively biased relative to the cathode tube 341, 342, so that the X-ray tube is switched through and the residual or surplus charge produces an electron beam E.

This electron beam E is deflected at the same time to the radiation absorber 11 by means of a deflection pulse because, while the switch 43*a* is open, a sufficiently high positive potential relative to the filament 33 is applied to the first tube half 341 by means of the second bias voltage source 42. Alternatively, in the closed position of the switch 43*a* and using appropriate anti-phase control of the second and third bias voltage sources 42, 43, a positive potential relative to the filament 33 can be applied to the first tube half 341 and a negative potential relative to the filament 33 to the second tube half 342.

It is to be noted that the deflection pulse is not generated later than the discharge pulse, but simultaneously therewith or preferably somewhat earlier. The durations of these pulses are such that the residual or surplus charge is essentially completely eliminated. A subsequent X-ray exposure can then be carried out with a defined high voltage and hence with a desired X-ray dose.

Figure 3:
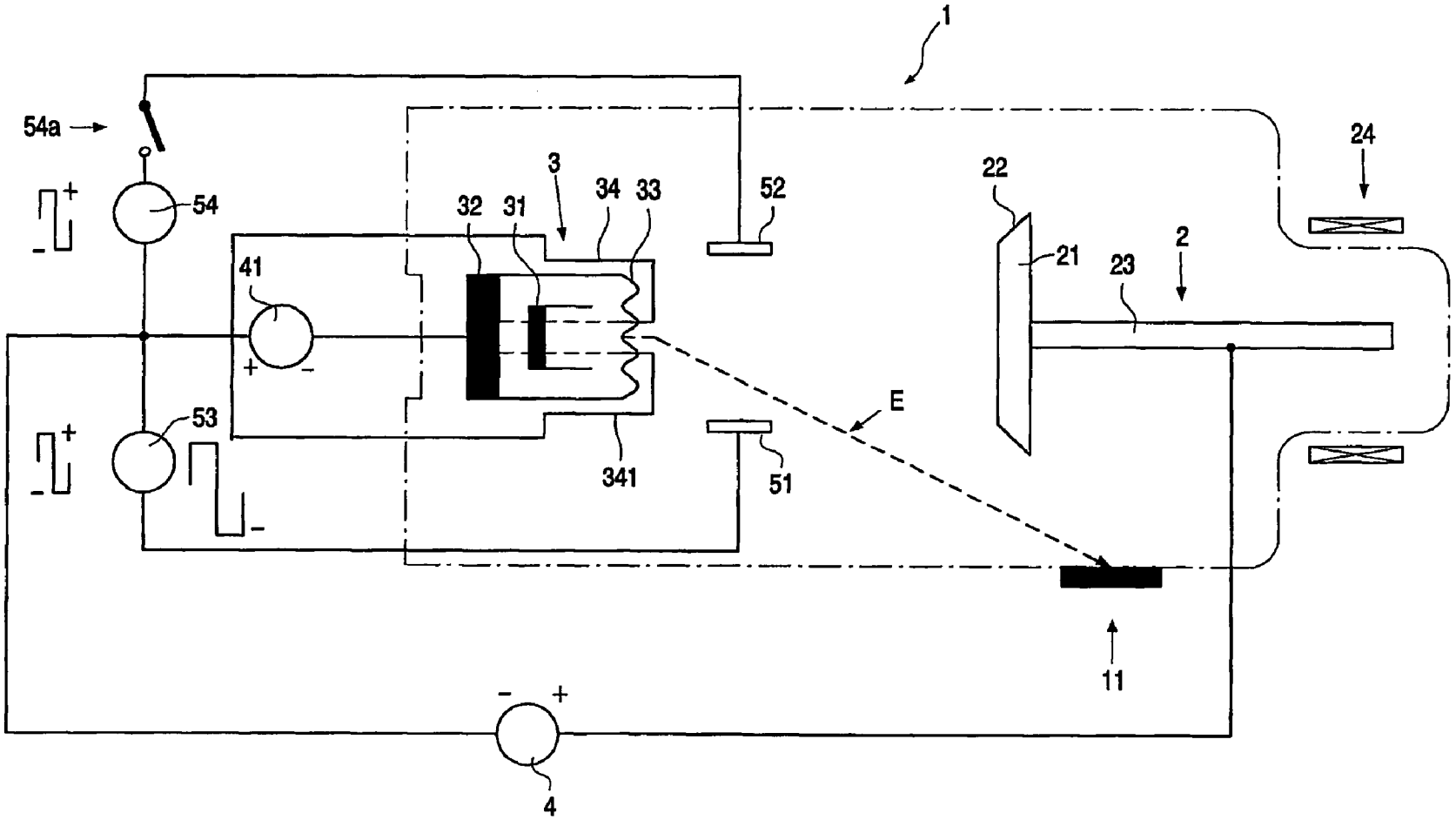
FIG. 3 shows a circuit diagram of a third embodiment of the invention.

FIG. 3 shows a third embodiment of the invention in which parts which are similar or identical to those shown in FIG. 1 or FIG. 2 are again denoted by the same reference numerals.

The X-ray tube shown in FIG. 3 again includes, accommodated in a tube envelope 1 of glass or metal, an anode 2 with an anode disc 21, a beveled edge zone 22 as well as an anode rod 23 which is rotated via a stator 24. Furthermore, there is provided a cathode 3 with a primary winding 31 and a secondary winding 32 of a filament transformer, as well as a filament 33. As opposed to the embodiments shown in the FIGS. 1 and 2, the cathode 3 in this case comprises a one-piece cathode tube 34. This cathode tube 34 can be positively or negatively biased relative to the filament 33 by means of a first bias voltage source 41.

Furthermore, this third embodiment is provided with a first and a second deflection plate 51, 52 which are arranged so as to face one another between the anode 2 and the cathode 3. In order to bias the first deflection plate 51 positively or negatively relative to the cathode tube 34, a second bias voltage source 53 is connected between the two deflection plates. Finally, a third bias voltage source 54 can be connected, via a switch 54*a*, to the second deflection plate 52 in order to bias this plate positively or negatively relative to the filament 33.

In the exposure mode this X-ray tube generates an X-ray beam in known manner in that, in the closed state of the switch 54*a* and while the filament 33 is negatively biased relative to the cathode tube 34 by means of the first bias voltage source 41, the released electrons are focused by the deflection plates 51, 52, accelerated by the anode voltage and directed, in the form of an electron beam, towards the edge zone 22 of the anode disc 21 where they excite the imaging X-rays.

After the termination of an exposure, notably by switching over the first bias voltage source 41 in such a manner that the cathode tube 34 is negatively biased relative to the filament 33 so that the tube is blocked, the residual or surplus charge must again be eliminated prior to the start of a new exposure with a lower high voltage.

To this end, the first bias voltage source 41 generates a discharge pulse whereby the filament 33 is negatively biased relative to the cathode tube 34, so that the X-ray tube is switched through and the residual or surplus charge produces an electron beam E.

At the same time, or briefly before that, in the open state of the switch 54*a* the second bias voltage source 53 generates a voltage (deflection pulse) which biases the first deflection plate 51 positively relative to the filament 33, so that the electron beam E is directed onto the radiation collector 11. Alternatively, in the closed state of the switch 54*a*, such deflection of the electron beam E can also be achieved by making the second and the third bias voltage source 53, 54 generate appropriate voltages of opposite phase whereby the first deflection plate 51 is biased positively relative to the filament 33 whereas the second deflection plate 52 is biased negatively relative to the filament 33.

The durations of these pulses are proportioned such that the residual or excess charge is eliminated essentially completely. Subsequently, an imaging exposure can again be performed with a defined high voltage and hence with a desired X-ray dose.

As stated before, the deflection plates 51, 52 serve to generate an electric field whereby the electron beam E is directed towards the radiation collector 11 and/or whereby it is defocused. The deflection plates 51, 52 can thus also be provided, if desired, on the external wall of the tube envelope 1, so that the interior of the X-ray tube need not be modified. On the other hand, the are also known X-ray tubes which comprise focusing plates or focusing electrodes for focusing the electron beam on the edge zone 22 of the anode disc 21. Generally speaking, in such a case the focusing plates can also be used as the deflection plates 51, 52 for deflecting the electron beam E towards the radiation collector 11.

Therefore, this embodiment is particularly advantageous for X-ray tubes which include deflection plates which are provided for the focusing of the electron beam in normal operation.

Figure 4:
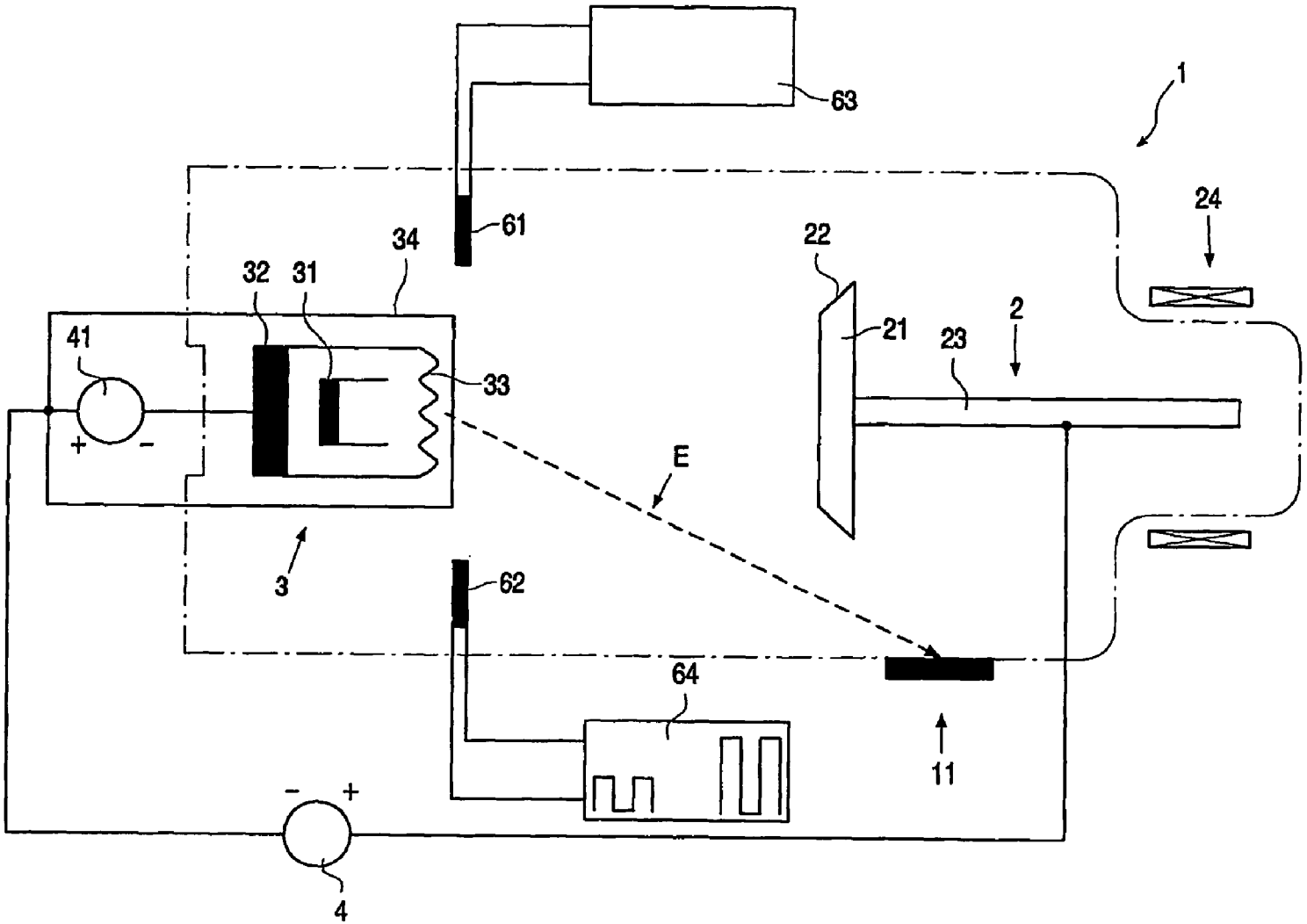
FIG. 4 shows a circuit diagram of a fourth embodiment of the invention.

FIG. 4 shows a fourth embodiment of the invention in which parts which are identical or similar to parts shown in the FIGS. 1 to 3 are again denoted by the same reference numerals.

This embodiment again comprises, accommodated in a tube envelope 1, an anode 2 with an anode disc 21 with a beveled edge zone 22 as well as an anode rod 23 which is rotated via a stator 24. There is also provided a cathode 3 with a one-piece cathode tube 34 as well as a filament 33 which is fed with current from a filament transformer which includes a primary winding 31 and a secondary winding 32.

Furthermore, between the cathode 3 and the anode disc 21 there is provided a first deflection coil 61 which is connected to a first current source 63, as well as a second deflection coil 62 which is fed by a second current source 64. However, the deflection coils 61, 62 may also be situated outside the tube envelope 1, notably on the external wall thereof. Furthermore, a quadrupole which is formed by a combination of four coils can be used instead of the two deflection coils.

Finally, this embodiment also includes a bias voltage source 41 for positively or negatively biasing the cathode tube 34 relative to the filament 33 as well as an anode voltage source 4 for applying an anode voltage between the anode 2 and the cathode 3.

After the termination of an X-ray exposure by blocking the tube by means of the cathode tube 34, being negatively biased relative to the filament 33 by the bias voltage source 41, the residual or surplus charge is again eliminated prior to the beginning of a new exposure. To this end, the bias voltage source 41 generates a discharge pulse whereby the filament 33 is negatively biased relative to the cathode sink 34.

At the same time there is generated a deflection pulse in that either the first and/or the second current source 63, 64 activates the first deflection coil 61 or the second deflection coil 62, thus generating a magnetic field such that the electron beam E produced by the residual or surplus charge is deflected towards the radiation collector 11 and/or is defocused until this charge has been eliminated.

Subsequently, an imaging exposure can be carried out again with a defined high voltage, and hence with a desired X-ray dose.

This embodiment is particularly advantageous for X-ray tubes which include magnet coils which are provided, for example, for focusing the electron beam in the normal exposure mode.

The individual characteristics of the described embodiments can also be combined, if desired.

In all embodiments the electron beam E produced by the residual or excess charge can also be directed towards the central part of the anode disc 21, so that the radiation collector 11 can be dispensed with. It is important only that it is not incident on the edge zone 22 of the anode disc 21 wherefrom the X-rays thus generated are reflected in the direction of the object to be examined.

Alternatively or additionally to the deflection, the electron beam E can also be defocused in all embodiments to such an extent that it is incident on the edge zone 22 with a low intensity only, so that the amount of X-rays thus generated is so small that it is acceptable. To this end, for example, focusing devices (electron lenses, coils or the like), already present in the X-ray tube, can be suitably defocused by suitable electrical control by means of a defocusing pulse.

Generally speaking, the radiation collector 11 is constructed as a suitably reinforced wall segment of the tube envelope 1. Alternatively, it may also be formed as a separate element absorbing the electron beam.

If necessary, additional elements can be provided for the absorption of the X-rays generated on the radiation collector 11 or the central part of the anode disc 21.

The discharge pulse and the deflection pulse can both be generated by a suitable circuit arrangement which includes either said first to third bias voltage sources or current sources 41; 42, 43; 53, 54; 63, 64, or which suitably controls voltage sources present in an X-ray system. The circuit arrangement is activated either automatically or by a user of the relevant X-ray system after an imaging X-ray exposure.

In the case of X-ray tubes comprising a stationary anode instead of an anode disc 21, the electron beam E produced by the residual or surplus charge can also be directed towards an existing catching cage.

The solution in accordance with the invention can also be used in the case of metal can tubes having a metal housing. It is then additionally possible to direct the electron beam E, produced by the residual or surplus charge, by way of a deflection pulse in the form of the interruption of the anode voltage, towards the positive metal housing, thus preventing the excitation of undesirable X-rays.

In the case of the previously mentioned X-ray tubes without a grid, in which the X-rays are switched on and off by switching the high voltage, a deflection pulse of the kind set forth can be used to achieve a substantial enhancement of the edge steepness with which the X-rays decay after the termination of an exposure, that is, notably in the case of pulse operation of the X-ray tube. Such a deflection pulse can be applied simultaneously with or briefly before the switching off of the high voltage to suitable deflection plates (51, 52) or magnet coils (61, 62) of such an X-ray tube, so that the electron beam produced by the residual charge is deflected away from the anode and/or is suitably defocused and the X-rays decay with a substantially greater edge steepness.

Finally, the principle of the invention, according to which an electron beam is deflected or defocused, can also be used in the case where this electron beam does not originate from a residual or surplus charge to be eliminated, but is produced in a different manner.

Figure 5:
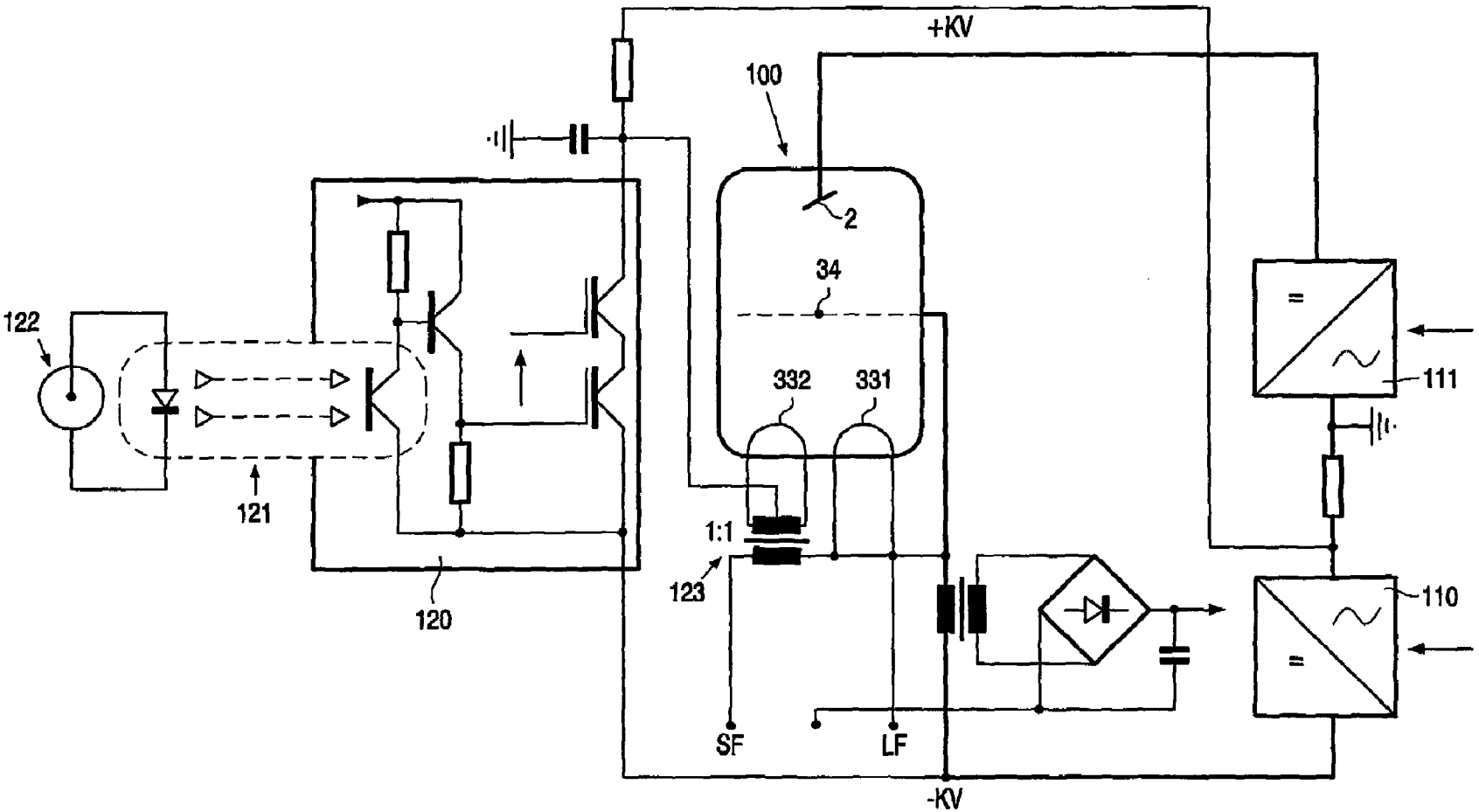
FIG. 5 shows a block diagram of a voltage supply unit for an X-ray tube.

FIG. 5 is a diagrammatic representation of a circuit arrangement as well as an X-ray tube 100 with an anode 2, two filaments 331, 332 of a cathode as well as a cathode tube 34 for blocking and switching through the tube. The filaments 331, 332, one of which is provided for a large focus (LF) while the other is provided for a small focus (SF), receive a filament current via a filament transformer (not shown). A high-voltage supply unit, consisting of a first stage 110 and a second stage 111, forms an anode voltage (kV voltage) from an alternating voltage which is supplied by a converter (not shown). The Figure also shows diagrammatically a voltage or current supply and control unit 120 which can be activated by an operator via a switch 122 which is connected by means of an optical conductor 121. The unit 120 is connected to the first stage 110 of the high voltage supply unit as well as, via a converter 123, to the filaments 331, 332 and the cathode tube 34.

The unit 120 serves to generate the described discharge pulses whereby the X-ray tube 100 is switched through, as well as to generate at the same time the deflection pulses whereby the electron beam arising because of the residual or surplus charges is deflected towards a radiation collector (not shown).

The voltage or current supply and control unit 120 may also be constructed so as to form part of a high-voltage generator for an X-ray tube.

The invention claimed is:

1. An X-ray tube comprising means for generating a deflection pulse for deflecting and/or defocusing an electron beam, generated by a residual or surplus charge present in a high-voltage circuit of the X-ray tube, so that at least it is not incident to a significant extent on a region of an anode wherefrom X-rays excited thereby are directed towards an object to be examined, wherein said means has a first device that can be activated between two successive exposures, and a second device that can be activated between successive exposures so as to be capable of generating a discharge pulse for triggering the electron beam so that the residual or surplus charge present in the high-voltage circuit of the X-ray tube is eliminated at least substantially.

2. An X-ray tube as claimed in claim 1, in which the first device includes a divided cathode tube with a first tube half and a second tube half of a cathode of the X-ray tube, as well as at least one voltage source whereby the tube halves can be connected to different electrical potentials in order to trigger the electron beam and to deflect and/or defocus the triggered electron beam.

3. An X-ray tube as claimed in claim 1, in which the first device includes at least one deflection plate which is connected to a voltage source in order to generate an electrical field whereby the electron beam is deflected and/or defocused.

4. An X-ray tube as claimed in claim 1, in which the first device includes at least one deflection coil which is connected to a current source in order to generate a magnetic field whereby the electron beam is deflected and/or defocused.

5. An X-ray tube as claimed in claim 1, wherein said means further comprises a radiation collector towards which the deflected electron beam is directed.

6. A voltage or current supply and control unit for an X-ray tube as claimed in claim 1 which serves to generate deflection pulses for deflecting and/or defocusing an electron beam produced by a residual or surplus charge present in a high-voltage circuit of the X-ray tube, in such a manner at least it is not incident to a significant extent on a region of an anode wherefrom X-rays excited thereby are directed towards an object to be examined.

7. A high-voltage generator for an X-ray tube as claimed in claim 1, which includes a voltage or current supply and control unit which serves to generate deflection pulses for deflecting and/or defocusing an electron beam, produced by a residual or surplus charge present in a high-voltage circuit of the X-ray tube, in such a manner at least it is not incident to a significant extent on a region of an anode wherefrom X-rays excited thereby are directed towards an object to be examined.

8. A high-voltage generator for an X-ray tube as claimed in claim 1, which includes a voltage or current supply and control unit which serves to generate discharge pulses for triggering the electron beam so that the residual or surplus charge present in the high-voltage circuit of the X-ray tube is eliminated at least substantially.

9. An X-ray tube having means for generating a deflection pulse for deflecting and/or defocusing an electron beam so that at least the beam is not incident to a significant extent on a region of an anode wherefrom X-rays excited thereby are directed towards an object to be examined, wherein the means includes first means capable of being activated between two successive exposures, and second means capable of being activated between two successive exposures so as to be capable of generating a discharge pulse for triggering the electron beam so that the residual or surplus charge present in the high-voltage circuit of the X-ray tube is eliminated at least substantially.

10. An X-ray tube as claimed in claim 9, in which the second means includes at least one voltage source whereby the electron beam is triggered by switching through the X-ray tube.

11. A voltage or current supply and control unit for an X-ray tube as claimed in claim 9 which serves to generate discharge pulses for triggering the electron beam so that the residual or surplus charge present in the high-voltage circuit of the X-ray tube is eliminated at least substantially.

12. A high-voltage generator for an X-ray tube as claimed in claim 9, which includes a voltage or current supply and control unit which serves to generate deflection pulses for deflecting and/or defocusing an electron beam, produced by a residual or surplus charge present in a high-voltage circuit of the X-ray tube, in such a manner at least it is not incident to a significant extent on a region of an anode wherefrom X-rays excited thereby are directed towards an object to be examined.

13. A high-voltage for an X-ray tube as claimed in claim 9, which includes a voltage or current supply and control unit which serves to generate discharge pulses for triggering the electron beam so that the residual or surplus charge present in the high-voltage circuit of the X-ray tube is eliminated at least substantially.

* * * * *